US007883379B2

(12) United States Patent
Feldman

(10) Patent No.: US 7,883,379 B2
(45) Date of Patent: Feb. 8, 2011

(54) BATTERY POST CLAMP

(76) Inventor: Thomas H. Feldman, 905 W. 16th St., Newport Beach, CA (US) 92663

( * ) Notice: Subject to any disclaimer, the term of this patent is extended or adjusted under 35 U.S.C. 154(b) by 216 days.

(21) Appl. No.: 12/209,053

(22) Filed: Sep. 11, 2008

(65) Prior Publication Data

US 2010/0062661 A1 Mar. 11, 2010

(51) Int. Cl.
*H01R 11/01* (2006.01)

(52) U.S. Cl. ..... 439/756

(58) Field of Classification Search ..... 439/756, 439/754, 522, 763, 767, 769, 773, 504, 765, 439/677, 755, 762, 726, 757, 759
See application file for complete search history.

(56) References Cited

U.S. PATENT DOCUMENTS 2,250,841 A * 7/1941 Randall ..... 439/756
3,407,382 A * 10/1968 Haegert ..... 439/763
5,597,331 A * 1/1997 Gable et al. ..... 439/754
6,459,233 B1 * 10/2002 Liang ..... 320/105

* cited by examiner

*Primary Examiner*—Edwin A. Leon
(74) *Attorney, Agent, or Firm*—Walter A. Hackler

(57) ABSTRACT

A battery post connector and harness in accordance with the present invention includes a pair of generally rectilinear jaws with each jaw having a peripheral notch sized and shaped to fit against a battery post. The jaws are abuttable with the notches facing one another to encompass the battery post. A pair of spaced apart bolts are provided with each bolt passing through the jaw transverse to the battery post and each bolt includes a head on one end thereof and a nut on the other end thereof for tightening jaws against the battery post. This enables the bolt to attach the cables to the jaws in a parallel relationship with respect to one another.

10 Claims, 2 Drawing Sheets

BATTERY POST CLAMP

The present invention generally relates to a battery terminal connector and more particularly is directed to a battery terminal connector that enables multiple batteries to be connected in a spaced conserving manner particularly useful in a marine environment.

Prior art battery terminal connectors for connecting one or more electrical cables to a battery post have included elastically formable gripping portions which are slit so that the gripping portion can be opened and closed around the battery post.

Unfortunately, battery terminal connectors which have a slit or hinged gripping portion, which is clamped to a battery post, do not provide uniform coupling of the connector to the battery post.

In addition, the prior art does not provide for a coupling of secondary connections to the battery post separate from the primary connector which provides power for the principal function of the RV, automobile, or marine vessel. A battery post connector in accordance with the present invention includes advantages which will be apparent to those the art and cognizant of the following detailed description:

SUMMARY OF THE INVENTION

A battery post connector in accordance with the present invention generally includes a pair of generally rectilinear jaws with each of the jaws having a peripheral notch sized and shaped to fit against a battery terminal post. The jaws are abuttable with the notches facing one another to encompass the battery post. In this manner, uniform battery post capture is achieved between the jaws and the post. Since the jaws are not pivoted, as is the case with a split battery post connectors, a uniform capture of the post between the jaws is accomplished.

A pair of spaced apart bolts are provided with each bolt passing through jaw sides transverse to the battery post. The use of spaced apart bolts, each being transverse to the battery post, enables the capture of the battery post uniformly in the jaws which is otherwise not possible with prior art devices.

Each of the bolts have a head on one end thereof and a nut on an opposite end thereof enabling uniform tightening of the jaws against the battery post and enabling attachment of cables to the jaws in a parallel relationship with respect to one another.

This parallel relationship is important in connecting a multitude of batteries in marine environments and for enabling shorter interconnection of batteries which thus reduces IR loss during transfer of energy from the batteries to an engine in a starting mode.

Preferably, the bolts are parallel to one another in order to provide uniform engagement, or grasping of the battery opposed to by the jaws.

In addition, the battery post connector in accordance with the present invention provides and enables the innerconnection of auxiliary devices to the battery by the way of auxiliary terminals which are disposed on the top of at least one jaws. Preferably, the jaws comprise a conductive metal such as one selected from a group consisting of copper, brass, aluminum, and alloys thereof.

In combination, the present invention provides for a battery connection harness which includes a plurality of battery post connectors with each connector including a pair of generally rectilinear jaws, with each jaw having a peripheral notch sized and shape to fit against the standard battery post. The jaws are abuttable with the notches facing one another to encompass a battery post.

A pair of battery bolts are provided with each bolt passing through the jaw sides transverse to the battery post.

The harness further includes a plurality of battery cables which are connected by the bolts to the jaws of each battery post with each cable being in a generally parallel relationship that enables a side-by-side battery-to-battery connection with a straight lengths of cable.

BRIEF DESCRIPTION OF THE DRAWINGS

The invention will be more readily understood by referenced to the drawings wherein like numeral characters refer to like elements.

DETAILED DESCRIPTION

Figure 1:
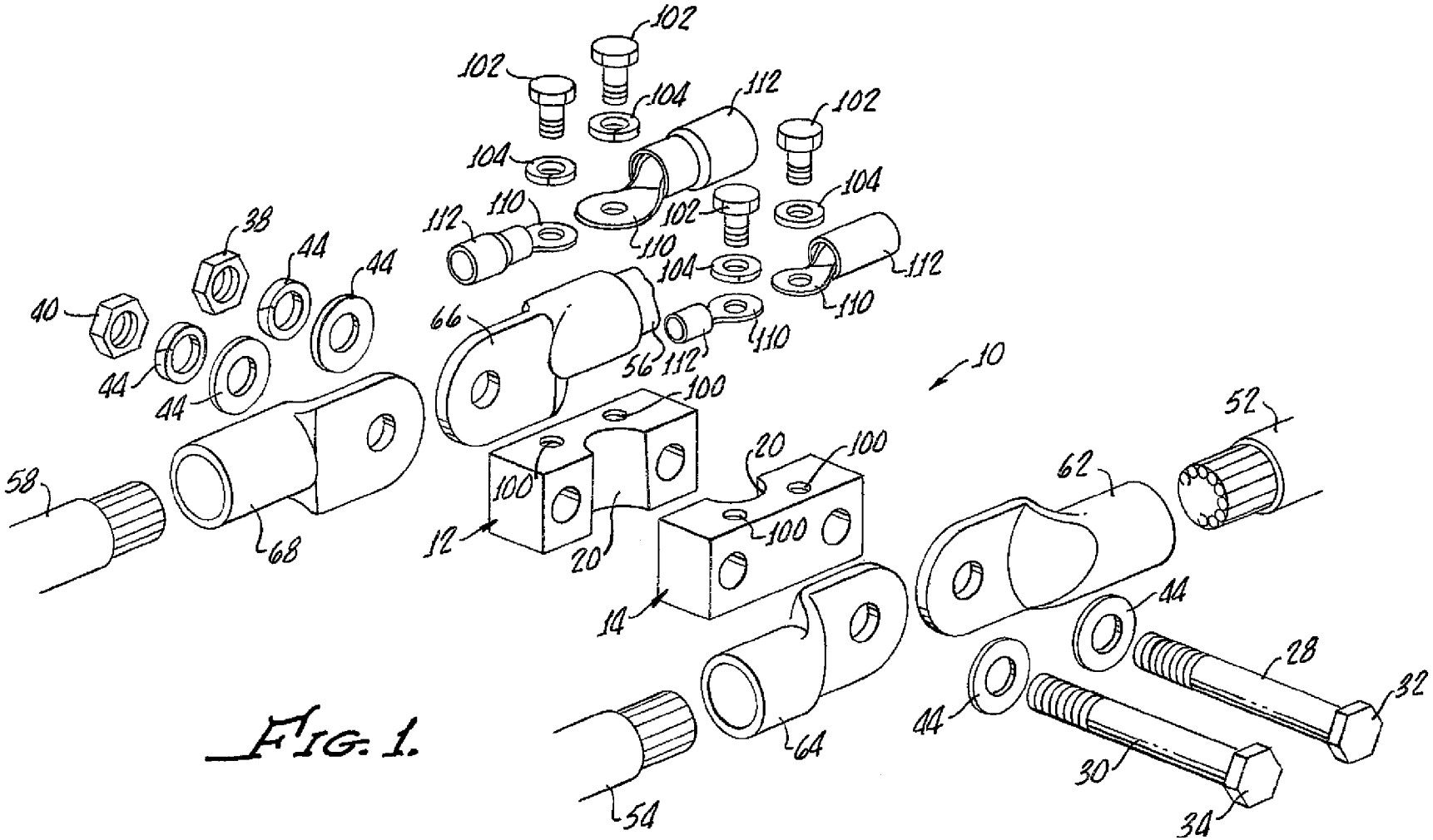
FIG. 1 is a perspective view of a battery post connector in accordance with the present invention generally showing a pair of generally rectilinear jaws with peripheral notches sized and shaped to fit against a standard battery post along with a pair of spaced apart bolts for tightening the jaws against a battery post, not shown, along with auxiliary terminal connections.
Figure 2:
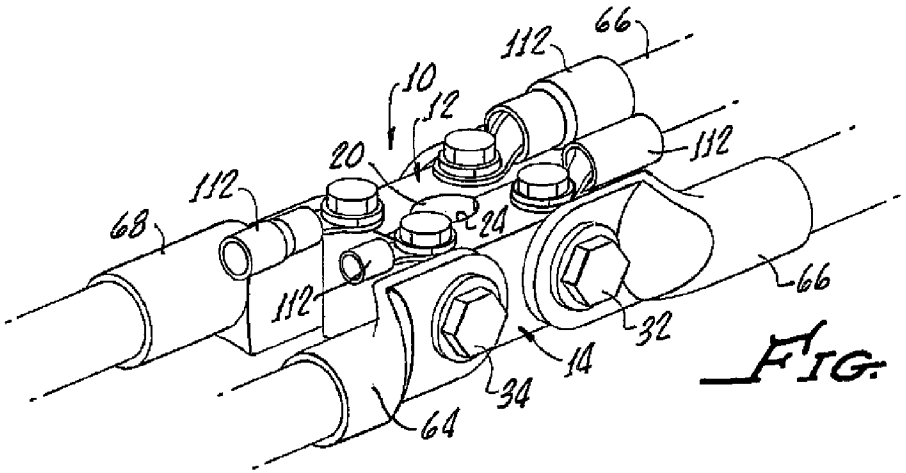
FIG. 2 is a view of the battery post connector shown in FIG. 1 in a assembled configuration.
Figure 3:
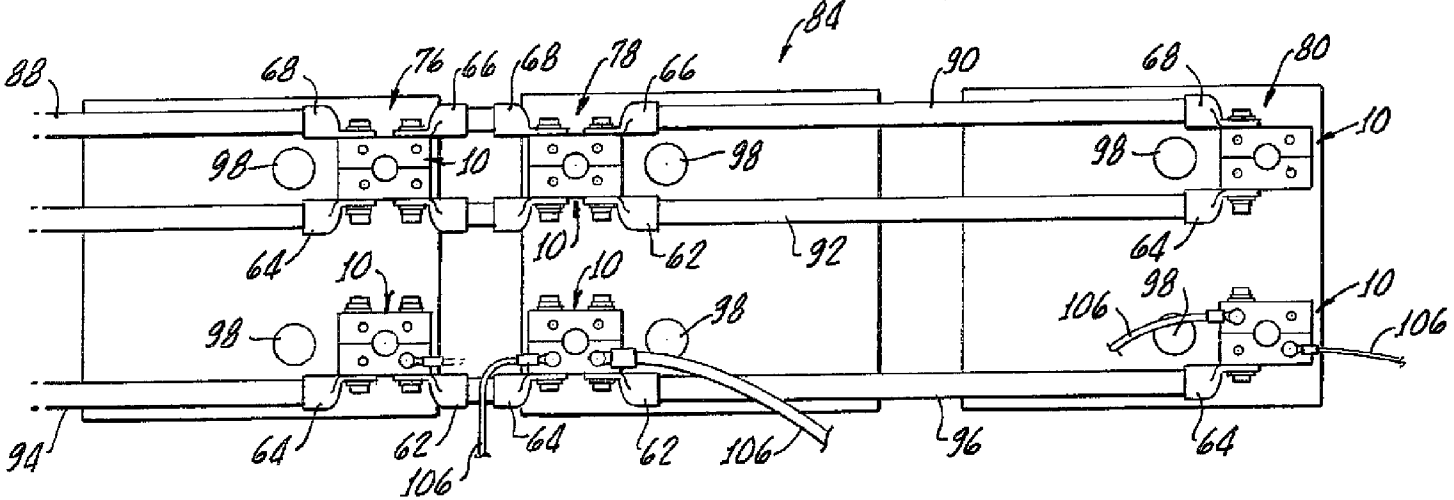
FIG. 3 is a battery connection harness enabling compact assembly of batteries reducing IR losses as well as enabling ready access to filling ports in the case of lead acid batteries.

With reference to FIGS. 1-3, a battery post connector 10 in accordance with the present invention includes a pair of generally rectilinear jaws 12, 14 sized and shaped to fit against a conventional battery post, not shown, with the jaws 12, 14 being abuttable with notches 20, 22 facing one another to encompass the battery post, not shown. The notches 20, 22 further may include a ten percent slope to accommodate a conventional tapered battery post, not shown.

A pair of spaced apart bolts 28, 30 each including a head 32, 34 and a nut 38, 40 along with optional washers 44 enable tightening of the jaws 12, 14 against the battery post, not shown, as illustrated in FIG. 2.

The bolts 28, 30, enable attachment of cables 52, 54, 56, 58 by way of conventional connectors 62, 64, 66, 68 to the jaws 12, 14 in a generally parallel relationship with one another as not only illustrated in FIGS. 1 and 2, but further shown in FIG. 3.

It should be appreciated that additional connectors, not shown, may be coupled to the jaws 12, 14 by the bolts 28, 30 to provide at least eight major power connections suitable for starting engines and the like to the battery post connector 10.

In order to minimize IR loss, the jaws 12, 14 may be formed from suitable conductive material such as copper, brass, aluminum, or alloys thereof.

As illustrated in FIG. 3, the plurality of battery post connectors 76, 78, 80 may be combined to form a harness 84 in accordance with the present invention.

In this arrangement, a plurality of battery cables, 88, 90, 92, 94, 96 are connected by corresponding bolts 28, 30 and nuts 38, 40, as hereinabove described, for connecting each of cables 88, 90, 92, 96 in a parallel relationship which thereby enables side-by-side battery-to-battery connection with straight lengths of cables 88, 90, 92, 94, 96 therebetween.

Importantly, this arrangement enables access to battery fill ports 98 enabling replenishment of battery fluid without removal of the cables 88, 90, 92, 94, 96.

The connector 10 in accordance with the present invention also provides for the connection of auxiliary devices, not shown, by way of auxiliary terminals, or taps, 100 for receiving screws 102 and washers 104 for receiving auxiliary connector 110 and wires 112.

Although there has been hereinabove described a specific battery post clamp in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A battery post connector comprising:

a pair of generally rectilinear jaws, each jaw having a peripheral notch sized and shaped to fit against a standard battery post, the jaws being abuttable with the notches facing one another to encompass the battery post; and a pair of spaced apart bolts, each bolt passing through jaw sides transverse to the battery post, each bolt having a head on and one end of the bolt and a nut on an opposite end of the bolt for tightening jaws against the battery post, each head and each nut of each bolt enabling separate attachment of cables to the jaws, the attached cables being oriented in a parallel relationship with respect to one another and disposed on opposite sides of the battery post.

2. The connector according to claim 1 wherein the bolts are parallel to one another.

3. The connector according to claim 1 further comprising at least one auxiliary terminal disposed on a top of at least one of the jaws.

4. The connector according to claim 1 wherein the jaws comprise a metal selected from a group consisting of copper, brass, aluminum, and alloys thereof.

5. A battery post connection comprising:

a pair of generally rectilinear jaws, each jaw having a peripheral notch sized and shaped to fit against a standard battery post, the jaws being abuttable with the notches facing one another to encompass the battery post;

a pair of spaced apart bolts, each bolt passing through jaws sides transverse to the battery post, each bolt having a head on one end of the bolt and a nut on another end of the bolt for tightening the jaws against the battery post; and a plurality of battery cables connected by the bolts to the jaws with each cable being in a parallel relationship and disposed on opposite sides of the battery post.

6. The connector according to claim 5 wherein the bolts are parallel to one another.

7. The connector according to claim 5 wherein the jaws comprises a metal selected from a group consisting of copper, brass, aluminum, and alloys thereof.

8. A battery connection harness comprising:

a plurality of battery post connectors, each connector comprising:

a pair of generally rectilinear jaws, each jaw having a peripheral notch sized and shaped to fit against a standard battery port, the jaws being abuttable with the notches facing one another to encompass a battery port;

a pair of spaced apart bolts, each bolt passing through jaws sides transverse to the battery post, each bolt having a head on one end of the bolt and a nut on an opposite end of the bolt for tightening the jaws against the battery post; and a plurality of battery cables connected by the bolt to the jaws of each battery post connector with each cable being in a parallel relationship and disposed on opposite sides of corresponding battery post for enabling side by side battery to battery connection with straight lengths of cable.

9. The harness according to claim 8 wherein the bolts of each connector are parallel with one another.

10. The harness according to claim 8 wherein the jaws comprise a metal selected from a group consisting of copper, brass, aluminum, and alloy thereof.

* * * * *